United States Patent [19]

Panicker et al.

[11] 4,182,584

[45] Jan. 8, 1980

[54] MARINE PRODUCTION RISER SYSTEM AND METHOD OF INSTALLING SAME

[75] Inventors: Narayana N. Panicker, Grand Prairie, Tex.; Fredric L. Hettinger, Ojai; Darrell L. Jones, Ventura, both of Calif.

[73] Assignee: Mobil Oil Corporation, New York City, N.Y.

[21] Appl. No.: 923,118

[22] Filed: Jul. 10, 1978

[51] Int. Cl.[2] ..... F16L 1/00; B63B 35/00

[52] U.S. Cl. ..... 405/195

[58] Field of Search ..... 405/203, 195, 188, 191, 405/158; 9/8 P; 141/388, 387, 279

[56] References Cited

U.S. PATENT DOCUMENTS

| | | | |
|---|---|---|---|
| 3,261,398 | 7/1966 | Haeber | 166/352 |
| 3,363,683 | 1/1968 | Corley et al. | 166/355 |
| 3,372,745 | 3/1968 | Holmes | 166/368 |
| 3,504,741 | 4/1970 | Baker et al. | 166/356 |
| 3,515,182 | 6/1970 | Dickson et al. | 141/387 |
| 3,535,883 | 10/1970 | Manning | 405/210 |
| 3,557,396 | 1/1971 | Rupp | 9/18 |
| 3,605,668 | 9/1971 | Morgan | 114/293 |
| 3,641,602 | 2/1972 | Flory et al. | 9/18 |
| 3,677,310 | 7/1972 | Dobler et al. | 141/1 |
| 3,700,014 | 10/1972 | Scales et al. | 141/279 |
| 3,756,293 | 9/1973 | Adler et al. | 141/279 X |
| 3,911,688 | 10/1975 | Behar et al. | 405/171 |
| 4,031,919 | 6/1977 | Ortloff et al. | 137/799 |

OTHER PUBLICATIONS

Ocean Industry, May 1977 p. 15

*Primary Examiner*—Dennis L. Taylor

*Attorney, Agent, or Firm*—C. A. Huggett; Drude Faulconer

[57] ABSTRACT

A free-standing, marine production riser and a method of installing same for use in deep-water areas to conduct fluids between the marine bottom and the surface. The riser system is comprised of a lower rigid section and an upper flexible section. The lower rigid section has a casing extending from a preset base on the marine bottom to a point just below the zone of turbulence which exists near the surface of the water. A variable-buoyant buoy having a curved upper surface and a central passage therethrough is mounted on the upper end of the casing to support the casing in a substantially vertical position when the casing is in position on the preset base. A remotely actuated connector assembly is provided on the lower end of the casing for connecting the casing to the preset base. A plurality of conduits are run through the passage in the buoy and through guide means in the casing and are remotely connected to mating conduits on the base. Each of a plurality of flexible flowlines is connected to a respective conduit at a point within the passage in the buoy. Each of the flexible flowlines is of sufficient length to extend over the upper curved surface of the buoy which provides a natural bending radius for the flexible flowlines and then downward through a catenary loop before extending upward to the surface. The flowline length also will be sufficient to maintain a catenary loop in the flowline at all times during normal operating conditions. All of the upper ends of the flexible flowlines are connected to a single flange which, in turn, is adapted to be quickly connected to and disconnected from a floating facility at the surface. In turn, each flexible flowline can be individually installed and/or removed.

19 Claims, 10 Drawing Figures

MARINE PRODUCTION RISER SYSTEM AND METHOD OF INSTALLING SAME

BACKGROUND OF THE INVENTION

The present invention relates to a marine riser system and a method of installing same and more particularly relates to a free-standing, marine riser for use in deep water areas to conduct fluids between the marine bottom and the surface.

A critical consideration in the production of hydrocarbons from marine deposits lies in providing a fluid communication system from the marine bottom to the surface once production has been established. Such a system, commonly called a production riser, is usually comprised of one or more conduits through which various, produced fluids are transported to and from the surface.

In many offshore production areas, a floating facility is commonly used as a production and/or storage platform. Since the facility is constantly exposed to surface conditions, it experiences a variety of movements, e.g., heave, roll, pitch, drift, etc. In order for a prduction riser system to adequately function with such a facility, it must be sufficiently compliant to compensate for such movements over long periods of operation without failure.

Also, as is commonly known, a zone of turbulence due to surface and near surface conditions exists just below the surface. For a riser system to have an acceptable operational life, it must also have sufficient compliance within this zone to compensate for the turbulence without interrupting the operation of the riser system.

Further, due to the water depths of some production areas, at least the lowermost elements of the riser system must be capable of being remotely installed without requiring any substantial assistance from divers. Likewise, the various elements of the riser system which undergo constant wear during operation, e.g., flowlines, must be capable of being removed individually for repair and/or replacement without requiring removal of the entire riser system. Finally, to provide for extremely hostile surface conditions, e.g., hurricanes, the riser must be capable of being quickly released from the floating facility and then being retrieved for reconnection once the surface conditions have subsided.

SUMMARY OF THE INVENTION

The present invention provides a free-standing, fully compliant marine production riser system capable of use in deep water production areas, including those areas having relatively hostile surface conditions. The lowermost elements of the riser system are capable of being remotely installed, with divers being needed only to install the upper elements which lie at a depth at which the divers can effectively and safely work. All of the flowlines in the system are such that each can be removed individually for repair and/or replacement without the need to shut down the entire riser system for extended periods. Further, the riser system can be quickly disconnected and then reconnected to a floating facility if the need arises.

More specifically, the riser system of the present invention is comprised of a lower, rigid section and an upper, flexible section. The lower, rigid section comprises a casing having a plurality of guide tubes therein adapted to receive a plurality of individual flow conduits. A remotely actuated connector assembly is attached to the lower end of the casing and is adapted to cooperate with a preset base on the marine bottom to guide the lower, rigid section into place and secure it to the base. A variable-buoyant buoy is affixed to the upper end of the casing and maintains the lower, rigid section in a vertical position when in place on the base. The casing is of sufficient length to extend from a preset base on the marine bottom to a point just below the turbulence zone near the surface, this being the wave zone which is affected by surface and near surface conditions, e.g., winds, waves, currents, etc.

The lower, rigid section is lowered and secured to the base on the marine bottom and the individual flow conduits are guided into their respective guide tubes within the casing. Each flow conduit is lowered through its guide tube and is remotely connected to a respective submerged flow source within the base. The upper, flexible section, comprised of individual flexible flow lines, is then lowered and each flexible flowline is attached to the upper end of a respective flow conduit in the casing. The flexible flow lines preferably are each of a different length to prevent entanglement with each other but all of sufficient length to allow each flexible flowline to extend upward from the lower flow conduit to which it is connected, through and over the upper surface of the buoy on the casing, and then downward to form a catenary loop before extending upward to the surface. The length of each flowline will be such that a catenary loop will be present therein at all times during operation of the riser system. The upper end of each flexible flowline is connected to a respective opening in a mounting flange so that all of the upper ends of the flexible flowlines are attached to a single flange, thereby allowing the flexible lines to be handled as a unitary bundle for quick and easy connection and disconnection to a floating facility. By maintaining at all times a sufficient catenary loop in each flexible line and by having only the flexible flowlines exposed to the turbulence zone, the riser system has excellent compliance which compensates for the normal heave, pitch, roll, and drift of the floating facility and for any normal turbulence encountered during operation without over-extending or damaging the riser system. Also, the catenary loop in each flexible line provides for minimum stresses as the flexible flowlines are extended and relieved during movement of the surface facility.

BRIEF DESCRIPTION OF THE DRAWINGS

The actual construction, operation, and the apparent advantages of the invention will be better understood by referring to the drawings in which like numerals identify like parts and in which.

DESCRIPTION OF THE PREFERRED EMBODIMENT

Figure 1:
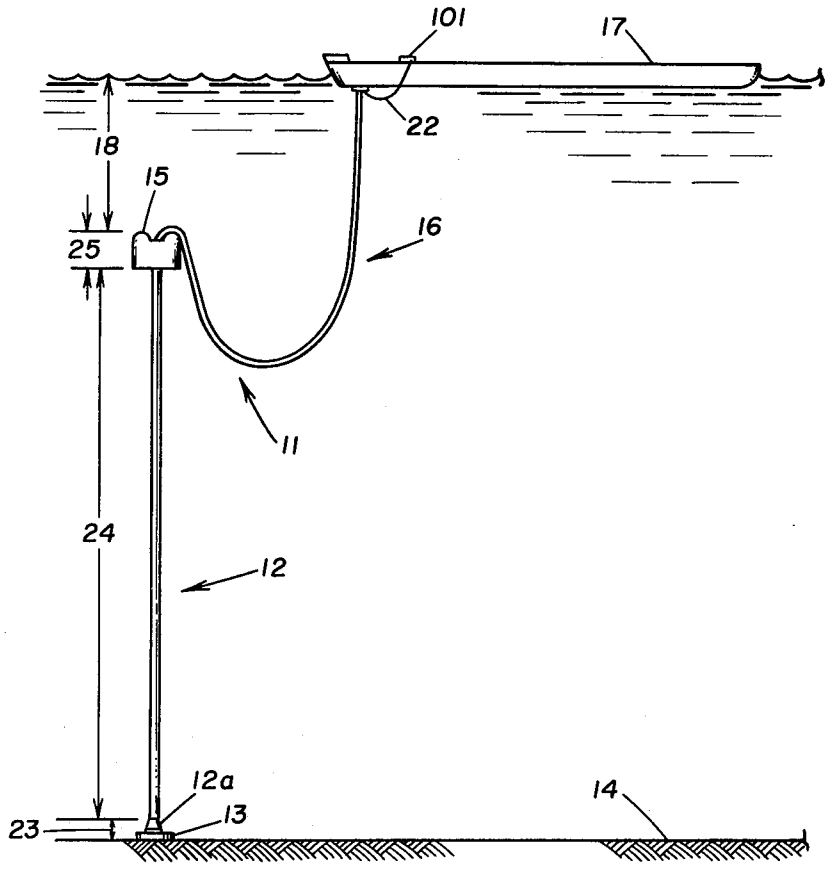
FIG. 1 is an elevational view of the present marine riser system in an operable position connected to a floating facility at an offshore location.

Referring more particularly to the drawings, FIG. 1 discloses marine riser system 11 of the present invention in an operational position at an offshore location. Riser system 11 is comprised of a lower rigid section 12 and an upper flexible section 16. As will be explained in more detail below, lower rigid section 12 has a base portion 23, an intermediate portion 24, and a buoy portion 25. A connector assembly 12*a* is affixed to the lower end of base portion 23 which cooperates with preset base element 13 to secure lower rigid section 12 to marine bottom 14. Buoy 15 is secured to the upper end of buoy portion 25 to maintain lower rigid section 12 in a vertical position under tension when in an operable position on base element 13.

As will be explained in more detail below, flexible section 16 is comprised of one or more flexible conduits which connect to respective one or more flow passages in rigid section 12. The flexible conduits extend upward through and over the upper surface of buoy 15 and then downward through catenary loops before extending upward to the surface of the water where they are connected to a floating facility 17. To permit the flexible section 16 to be disconnected from facility 17 (see FIG. 2) in case of an emergency, e.g., hurricane, and then be retrieved for reconnection, a tetherline 22 is attached at one end to the upper end of flexible section 16 and at its other end to which 101 on floating facility 17. When flexible section 16 is disconnected from facility 17, it will be lowered by tetherline 22 to the position shown in FIG. 2. A clump weight 19 is positioned at some intermediate point on tetherline 22, and anchor 20 is attached to the end thereof. A marker buoy 21 is attached to anchor 20 by line 21*a*, and tetherline 22, weight 19, and anchor 20 are lowered to marine bottom 14. After the emergency has passed, marker buoy 21 is retrieved and line 21*a* is reeled in to raise anchor 20, weight 19, and tetherline 22. Then by reeling in tetherline 22, upper end of flexible section 16 is brought to the surface of reconnection to facility 17.

Figure 2:
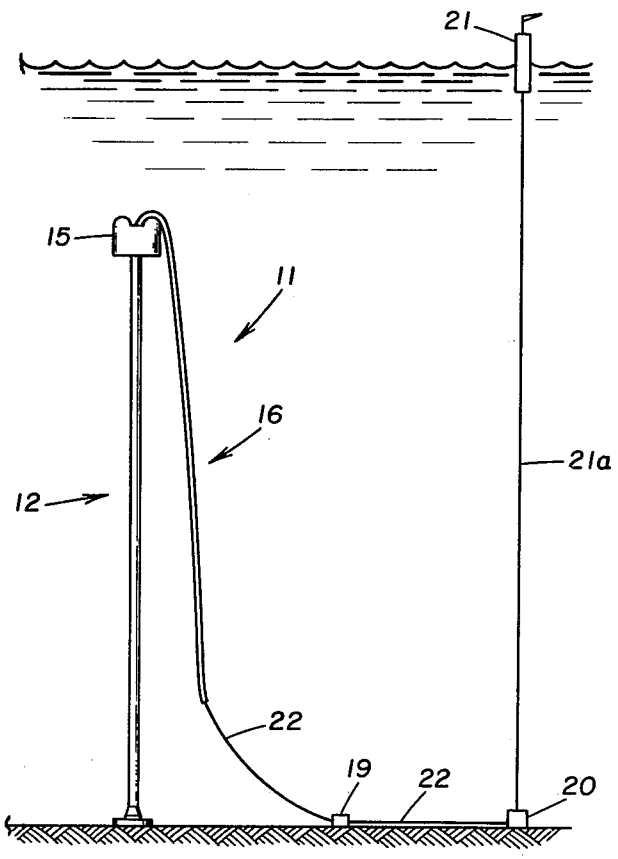
FIG. 2 is an elevational view of the riser system of FIG. 1 shown in an inoperable position disconnected from the floating facility.
Figure 4:
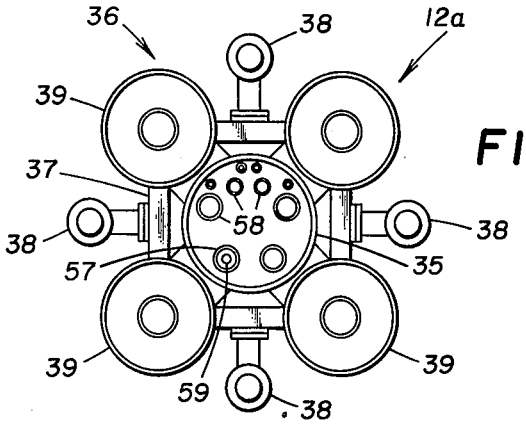
FIG. 4 is a view taken along line 4—4 of FIG. 3.
Figure 5:
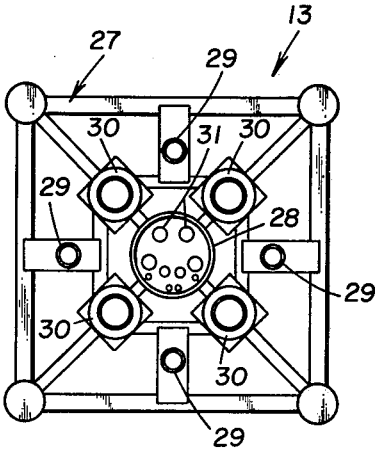
FIG. 5 is a view taken along line 5—5 of FIG. 3.
Figure 3:
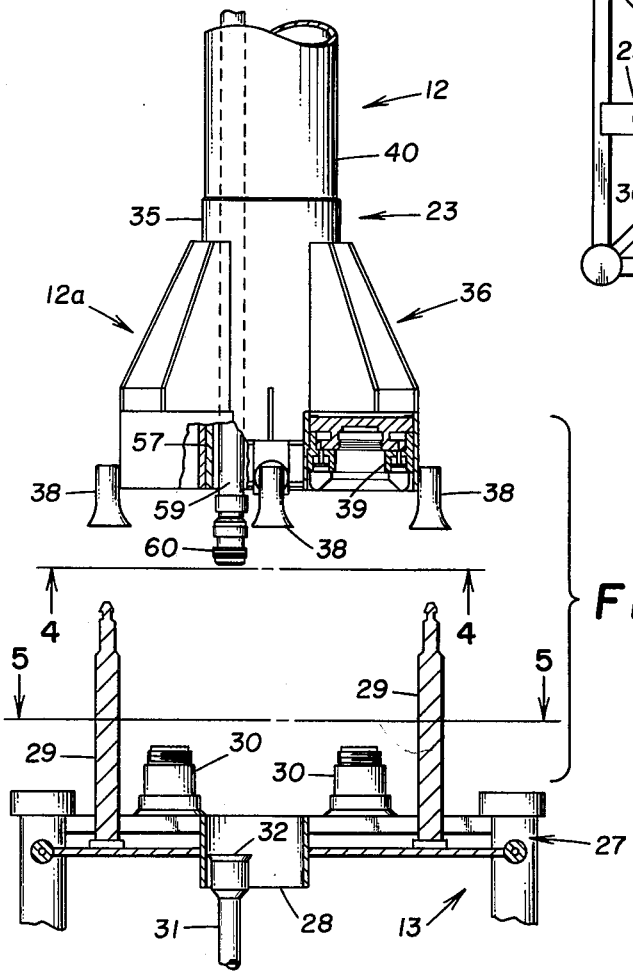
FIG. 3 is an exploded view, partly in section with parts removed for clarity, of the connector assembly on the lower end of the rigid section of the riser and the cooperating base element.

Referring now to the other figures, each component of the present system will be described in greater detail. FIGS. 3 to 5 disclose the details of base portion 23 of lower rigid section 12 and of base element 13. As seen in FIGS. 3 and 5, base element 13 is comprised of a frame 27 having a central housing 28 secured therein. A plurality of guide posts 29 are secured at spaced positions on frame 27 as are a plurality of male members 30 of a remote connector means (only one member 30 shown in FIG. 2 for clarity).

As understood in the art, base element 13 is first positioned and set on marine bottom 14. One or more conduits 31 (as shown in FIG. 2; ten shown in FIG. 4) connected to various submerged sources (not shown) e.g., produce oil and gas from subsea wells, control valves on said wells, etc., terminate within housing 28 and each has a female receptacle 32 of a remote connector, e.g., stab-in connector, on its upper end.

Lower base portion 23 of rigid section 12 is comprised of constant internal diameter (I.D.) casing 35 which preferably has a stepped outside diameter (O.D.). That is, the wall thickness of casing 35 decreases in steps from its bottom to its top. For example, in a practical situation where casing 35 is 60 feet long and has an I.D. of 56 inches, the wall thickness for the lower 20 feet is $1\frac{1}{2}$ inches, the wall thickness for the intermediate 20 feet is $1\frac{1}{4}$ inches, and the wall thickness for the upper 20 feet is 1 inch. This stepped wall thickness distributes the bending stresses over the entire length of casing 35 and prevents these stresses from exceeding the allowable limits in a single area.

A connector assembly 36 is attached to the lower portion of casing 35 and is comprised of a frame 37 having a plurality of guide sleeves 38 and female members 39 of a remote connector means secured thereto which are positioned to cooperate with guide posts 29 and male members 30, respectively, when connector assembly 36 is in position on base element 13. The remote connectors 30, 39 are positioned to carry the shear, tension, and bending loads from the riser system 11 to base element 13 and are of the type which can be connected and disconnected remotely, e.g., a connector having locking dog segments, a cam ring to actuate the dog segments, and hydraulically actuated pistons to position the cam ring to lock or unlock the dog segments. Such a connector is well known in the art and is commercially available, e.g., an H-4 connector maufactured by Vetco Offshore Industries of Ventura, Ca.

The intermediate portion 24 of rigid section 12 (see FIG. 1) is comprised of casing 40 having the same I.D. as base portion 23 and a uniform wall thickness throughout its length slightly less than that of casing 35, e.g., $\frac{3}{4}$ inch thick in the above example. Casing 40 is connected to casing 35 and has a length sufficient to extend from base portion 23 to a point just below turbulence zone 18 (see FIG. 1) which is that zone of water below the surface which is normally affected by surface conditions, e.g., currents, surface, waves, winds, etc. Connected to the top of casing 40 is buoy section 25.

Figure 6:
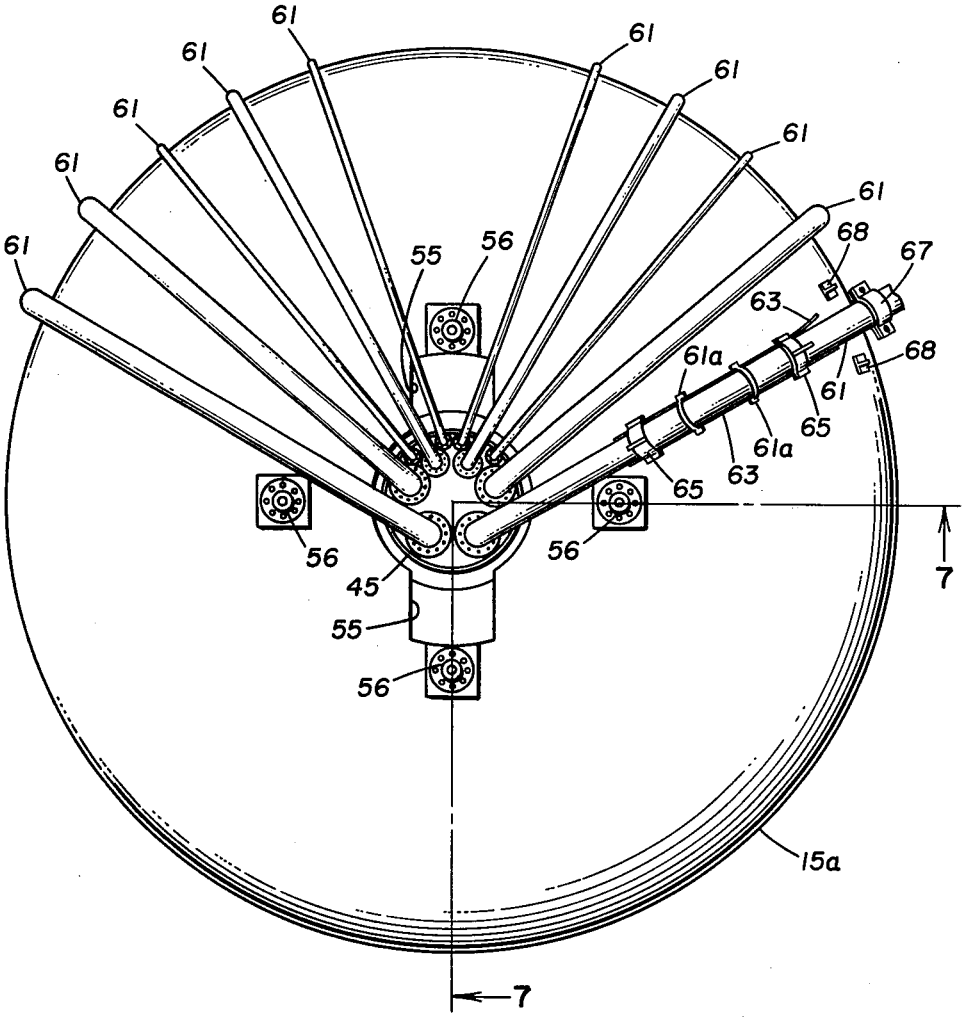
FIG. 6 is a top view of the buoy and flexible flowlines at the upper end of the rigid section of the present riser system.
Figures 7, 8:
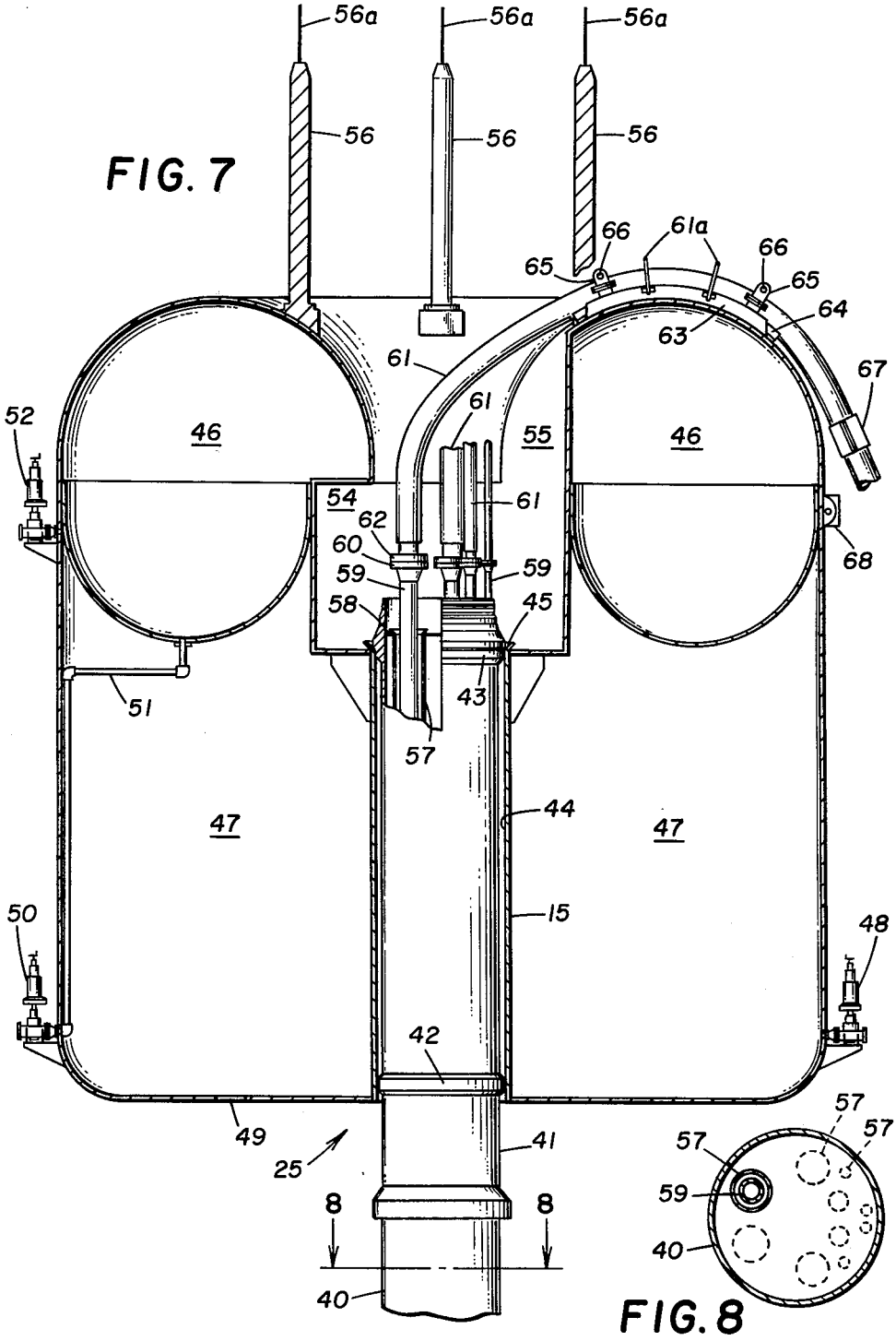
FIG. 7 is a view of the upper end of the rigid section of the riser system taken along line 7—7 of FIG. 6.
FIG. 8 is a cross-sectional view taken along line 8—8 of FIG. 7.
Figure 10:
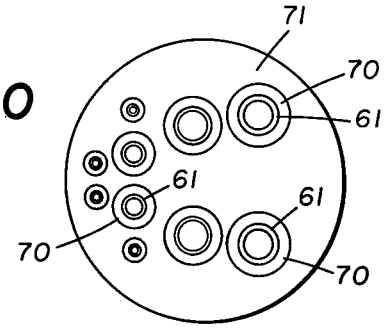
FIG. 10 is an enlarged view taken along line 10—10 of FIG. 9.

As seen in FIGS. 6 and 7, buoy section 25 comprises a casing 41 having the same I.D. as casing 40 but preferably having a slightly greater wall thickness, e.g., 1 inch in the above example, and has two stiffening rings 42, 43 thereon. Buoy 15 is comprised of a housing 15*a* having a shape of essentially a torus atop a hollow cylinder and having an inner wall 15*b* defining a central passage 44 through the entire length of buoy 15 into which casing 41 is positioned. The upper stiffening rings 43 fits into shouldered recess 45 on buoy 15 to transfer the buoyant force of buoy 15 to rigid section 12. The lower stiffening ring 42 bears against the internal diameter of passage 44 and together rings 42, 43 transfer the bending moments from buoy 15 to rigid section 12.

Buoy 15 is preferably fabricated with two separate chambers. The volume of upper chamber 46 provides sufficient buoynancy to float both buoy section 25 and base section 23 for a purpose to be explained later. Chamber 46 is kept dry at all times and is referred to as a fixed buoyancy tank. The buoyancy force of lower chamber 47 is variable by emptying and flooding chamber 47 through opening 49 by supplying or venting air through inlet valve 48 and vent 52, respectively. Chamber 46 can also be pressurized through valve 50 and line 51 to protect against collapse when buoy 15 is submerged.

The upper, interior of central passage 44 of buoy 15 is enlarged to form circular gallery 54 which provides a work space for divers during installation and maintenance operations. Access to gallery 54 is through either of two recesses 55 through the upper surface of buoy 15. Four guide posts 56 are affixed in space relation on the upper surface of buoy 15.

A plurality of guide tubes 57 are positioned within rigid section 12 and extend through the entire length of section 12, i.e., casings 35, 40, 41. Guide tubes 57 are held in proper position by alignment plates 58 (see FIG. 7) placed at spaced intervals, e.g., 20 feet, within the casings. An individual, rigid flow conduit 59 (see FIGS. 3 and 7) is run through each guide tube 57 and carries a remote connector 52, e.g., threaded stab connector, at its lower end which is adapted to mate with female receptacle 32 of its respective conduit 31. It should be understood that both the number and diameter of conduits 31 and mating flow conduits 59 may vary as the situation predicts. Each flow conduit 59 extends from base element 13 to a point within gallery 54 where it terminates with flange 60.

A flexible flowline 61 having a flange 62 on one end is connected to a respective flange 60 on a rigid flow conduit 59 within gallery 54. As best seen in FIG. 6, flexible flowlines 61 extend upward through buoy 15 and over the upper surface thereof. The toroidal shape of the upper surface of buoy 15 acts as a natural bending mandrel for flexible flowlines 61. Guide ribs 63 are welded to the upper buoy surface to form individual troughs (only one shown in FIG. 5) for each of flexible flowlines 61.

Preferably, each flexible flowline 61 has a curved cradle 64 (shown in FIG. 6) attached thereto clamped to a short portion of the underside thereof by means of clamps 65 which in turn have lifting eyes 66 therein. Cradle 64 provides a means of lifting and lowering the ends of flexible flowlines 61 while keeping the flanged ends of flexible flowlines 61 in position for connection to flow conduits 59. Preferably, the bottom of each cradle 64 is coated with a low friction material, e.g., polytetrafluoroethylene, to allow cradle 64 and hence flexible flowline 61 to slide over the surface of buoy 15 instead of sticking and imposing compressive forces on flexible flowline 61. This also protects flowlines 61 and buoy 15 from excess wear which would otherwise result from direct sliding contact with buoy 15. The flowlines 61 are held in their respective troughs by means of hold-down brackets **61*a*. A tie-off fitting 67 is clamped on each flexible flowline 61 which is used to transfer flexible flowline tension from flange 62 to buoy 15 during installation or removal of flexible flowlines 61. This is done by taking the tension on a chain (not shown) between fitting 67 and pad eye 68 on buoy 15**.

Figure 9:
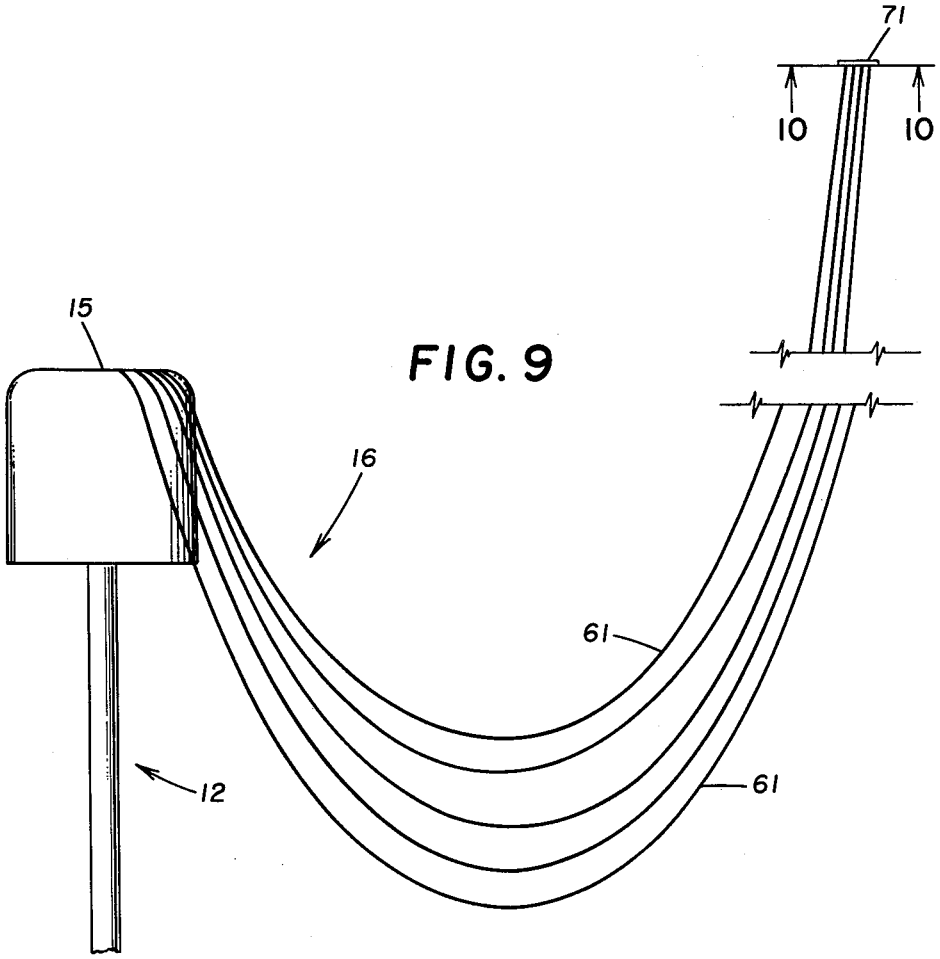
FIG. 9 is a perspective view of the buoy and flexible lines exiting from the top of the rigid section of the riser system and extending to the surface.

The upper end of each individual flowline 61 is fitted with a flange 70 (see FIG. 9) which, in turn, is affixed to the bottom of mounting flange 71 to tie all of the individual flexible flowlines 61 together at a single point. Mounting flange 70 is used to couple flexible flowlines 61 to respective lines (not shown) in floating facility 17 whereby all of the flowlines can be quickly connected or disconnected in a single operation.

Where a plurality of flexible flowlines 61 are used, the length of each individual flowline 61 will vary with respect to its position in the buoy connection pattern (see FIG. 8) but each will be of sufficient length to initially extend downward from buoy 15 to form a catenary loop in the line before extending upward to the surface. The catenary loops in the flowlines 61 provide riser system 11 with the compliancy necessary to compensate for all normally expected movements of facility 17. Also, the catenary loops provide a good operational life for the flexible section 16 since wear due to flexing and normal tension on flexible flowlines 61 during operation is not concentrated at a single point but is more evenly distributed over a substantial length of each flowline. The varying lengths of flexible flowlines 61 provide separation between the individual catenaries, thereby reducing the possibility of rubbing and/or wrapping between flowlines 61 during operation.

Having described all of the components of riser system 11, the preferred method of installing the riser will now be set forth. Preferably at a shore facility, the upper portion of casing 35 of base portion 23 is temporarily secured within passage 44 of buoy 15. Using the buoyancy of buoy 15, base portion 23 is towed to the desired offshore location. Necessary control lines, e.g., hydraulic lines for remote connectors 39, and a guidance package, e.g., television and/or sonar package (not shown), are connected to base portion 23. With the aid of a derrick-equipped vessel, e.g., semisubmersible drilling rig, a section of casing 40 of intermediate portion 24 is lowered through passage 44 of buoy 15 and is coupled to casing 35. Base section 23 is then disconnected from buoy 15 and is lowered until another section of casing 40 can be coupled to the first section of casing 40. This procedure is repeated until intermediate casing 40 is completed. Casing 41, having rings 42, 43, is then coupled to the upper section of casing 40. A special running tool (not shown) is used to couple the top of casing 41 to a drill pipe or casing. Guidelines **56*a* (FIG. 7) are connected to guideposts 56 on buoy 15** and are extended to the surface.

Air lines (not shown) are connected to valves 48, 50 and by controlling the buoyancy, i.e., flooding, of chamber 47, rigid riser section 12 is lowered onto preset base element 13. To guide rigid section 12 into proper alignment, guidelines (not shwon) extending from guidepost 29 through guide sleeves 38 can be used or it can be done without guidelines by using the television and/or sonar package on base portion 23 to guide sleeves 38 onto their respective posts 29. Once in position, remote connectors 39 are actuated to lock base portion 23 on preset base 13. Chamber 47 is then blown down to again adjust the buoyancy force of buoy 15, thereby transferring the buoyant force of buoy 15 to casing 41. The running tool and television and/or sonar package are released and retrieved.

Next, the individual rigid flow conduits 59 are run into their respective guide tubes 57 within rigid section 12. Flow conduits 59 are positioned through an appropriately spaced opening in a guide frame (not shown) and the male member of stab connector 60 is affixed to its lower end. Guidelines **56*a* are threaded through the guide frame which is then lowered thereon as sections of rigid flow conduit 59 are added. The guide frame, as it reaches buoy 15 will guide flow conduit 59 into its respective guide tube 57 within rigid section 12. By means of retrieval cables, the guide frame is pulled back to the surface and the remainder of flow conduit 59 is made up with flange 60** being affixed to the top of the last section.

A drill string or the like (not shown) is attached to flange 60 and is used to run the remainder of flow conduit 59 into guide tube 57 until male member 52 of the stab connector is securely fastened within female receptacle 32 on base element 13. The stab connector is of the type known in the art which will automatically lock upon insertion and is releasable upon rotation of the male member with respect to the female member. A pressure test or the like is then performed to verify a leak-tight connection between members 52 and 32, after which divers disconnect the drill string from flange 60 for recovery. This technique is repeated for each of the individual rigid flow conduits 59.

To install flexible section 16, each flexible flowline 61 is provided with a flange 62 at one end and a flange 70 at the other end. All flanges 70 are connected to mounting flange 71 which is maintained at the surface. A cradle 64 is attached to a first of flexible flowlines 61 and is lowered therewith into its respective trough on buoy 15 and secured therein by brackets 61*a*. A diver then secures a chain (not shown) from tie-off fitting 67 to pad eyes 68 on buoy 15 to transfer flexible flowline tension and to aid a diver in connecting flange 62 of flexible flowline 61 to flange 60 on rigid flow conduit 59. This procedure is repeated for each flowline 61. Mounting flange 71 is then connected to floating facility 17, and riser system 11 is ready for operation. If an emergency arises, e.g., hurricane, mounting flange 71 can be quickly disconnected from facility 17 and flexible section 16 can be lowered to the position shown in FIG. 2. After the emergency has passed, anchor 20, clump weight 19, and tetherline 22 can be retrieved by capturing buoy 21 and line 21*a* and by reeling in line 22, flange 71 is recovered for reconnection to facility 17.

It can be seen the catenary path defined by each flexible flowline provides excellent compliance for the system to compensate for normally expected movement of facility 17, e.g., rise and fall due to wave action, drift, etc. Also, due to the catenary path the flexure of flowlines 61 is distributed over a greater portion of their lengths and is not concentrated at a single point, thereby substantially increasing their reliability and operational life. Further, it can be seen that riser system 11 only requires divers to work in relatively shallow depths with all other connections being remotely actuated. By extending rigid flow conduits 59 upward into circular gallery 54 within buoy 15, the connections requiring divers can be easily and safely performed.

Still further, the present riser system allows the individual rigid conduits and/or flexible flowlines to be removed for maintenance and/or replacement without requiring the removal of the entire system. This may be done by merely reversing the installation steps.

What is claimed is:

1. A marine riser system comprising:

a lower rigid section comprising:

a casing of sufficient length to extend from the marine bottom to a point just below the water zone near the surface which is affected by surface conditions, a connector assembly attached to the lower end of said casing, guide means on said connector assembly adapted to cooperate with means on a base element preset on the marine bottom to properly position said lower rigid section on the base element, remotely actuated connector means on said connector assembly adapted to cooperate with means on the preset base element to secure said lower rigid assembly to the base element, at least one conduit within said casing and extending throughout the length thereof, said conduit having a remotely actuated connector on its lower end adapted to couple said conduit to a mating member within the preset base element, and a buoy mounted on the upper end of said casing, said buoy having sufficient buoyancy to support said lower rigid section in a substantially vertical position when said rigid section is in an operable condition; and an upper flexible section comprising:

at least one flexible flowline connected to said at least one conduit and extending in a curved path over said buoy and then downward through a catenary loop before extending upward to the surface, said flexible flowline being of sufficient length to maintain a catenary loop therein at all times during normal operating conditions.

2. The marine riser system of claim 1 wherein said buoy comprises:

a housing having an inner wall and an outer wall, said inner wall defining a central passage therethrough which receives said upper end of said casing, said housing having a toroidal-shaped upper surface connecting said inner wall and said outer wall, said upper surface providing the surface of said buoy over which said at least one flexible flowline extends; and means on said inner wall for coupling said buoy to said casing to transfer the buoyant force of said buoy to said casing.

3. The marine riser system of claim 2 including:

means for adjusting said buoyant force of said buoy.

4. The marine riser system of claim 3 wherein said means for adjusting the buoyant force of said buoy comprises:

means on said buoy for emptying and flooding at least a portion of said buoy with water.

5. The marine riser system of claim 2 wherein said at least one conduit comprises:

a plurality of individual conduits spaced within said casing;

and wherein said at least one flexible flowline comprises:

a plurality of individual flexible flowlines, each flexible flowline being connected at one end to a respective one of said plurality of individual conduits.

6. The marine riser system of claim 5 including:

a flange adapted to be connected to said floating facility, the other end of each of said plurality of flexible flowlines being connected to said flange.

7. The marine riser system of claim 6 wherein each of said plurality of individual flowlines is of a different length.

8. The marine riser system of claim 6 including:

means for adjusting said buoyant force of said buoy.

9. The marine riser system of claim 8 wherein said means for adjusting the buoyant force of said buoy comprises:

means on said buoy for emptying and flooding at least a portion of said buoy with water.

10. The marine riser system of claim 9 including:

means on said toroidal-shaped, upper surface of said buoy to define an individual trough for each of said plurality of said individual flexible flowlines as said flowlines curve over said upper surface of said buoy.

11. The marine riser system of claim 10 including:

means to retain each of said plurality of individual flexible flowlines in its respective said trough.

12. The marine riser system of claim 11 wherein the upper portion of said central passage in said buoy is enlarged to provide a gallery within said buoy for divers to work in, each of said flexible flowlines being connected to their respective conduit at a point within said gallery.

13. The marine riser system of claim 12 including:

guide means in said casing for maintaining each of said individual conduits in its relative position within said casing.

14. The marine riser system of claim 13 including:

guide means on said buoy for guiding each of said individual conduits into its respective said guide means in said casing when said lower rigid section is connected to said preset base element.

15. A method of installing a marine riser system having a buoy-supported lower rigid section and an upper flexible section, the method comprising:

releasably mounting the lowermost element of said lower rigid section within a central passage which extends completely through said buoy;

towing said buoy and said lowermost element to the offshore installation site, using the buoyant force of said buoy to float same during towing;

passing a section of casing into said passage in said buoy and connecting said casing to said lowermost element of said lower rigid section;

releasing said lowermost element from said buoy;

continue connecting sections of casing to previously connected sections of casing and lowering said lowermost element on said connected sections of casing through said passage in said buoy until said lower rigid section is of a predetermined length;

lowering said lower rigid section and said buoy onto a preset base on the marine bottom;

connecting said lowermost element to said preset base;

transferring the buoyant force of said buoy to the upper end of said lower rigid section to support said lower rigid section in a substantially vertically position;

connecting one end of said upper flexible section to the upper end of said lower rigid section at a point within said passage of said buoy; and connecting the other end of said upper flexible section to a floating facility at the surface.

16. A method of installing a marine riser system having a buoy-supported lower rigid section and an upper flexible section, the method comprising:

releasably mounting the lowermost element of said lower rigid section within a central passage which extends completely through said buoy;

towing said buoy and said lowermost element to the offshore installation site, using the buoyant force of said buoy to float same during towing;

passing a section of casing into said passage in said buoy and connecting said casing to said lowermost element of said lower rigid section;

releasing said lowermost element from said buoy;

continue connecting sections of casing to previously connected sections of casing and lowering said lowermost element on said connected sections of casing through said passage in said buoy until said lower rigid section is of a predetermined length;

lowering said lower rigid section and said buoy onto a preset base on the marine bottom;

connecting said lowermost element to said preset base;

transferring the buoyant force of said buoy to the upper end of said lower rigid section to support said lower rigid section in a substantially vertically position;

passing at least one flow conduit through said passage in said buoy and through said lower rigid section;

connecting said at least one flow conduit to a respective flow source on said preset base;

connecting one end of at least one flexible flowline to the upper end of said at least one flow conduit at a point within said passage in said buoy; and connecting the other end of said at least one flexible flowline to a floating facility on the surface.

17. The method of claim 16 wherein said step of lowering said lower rigid section and said buoy includes:

flooding at least a portion of said buoy with water.

18. The method of claim 17 wherein said step of transferring said buoyant force to said lower rigid section includes:

emptying said at least a portion of said buoy of said water.

19. The method of claim 18 including:

passing additional flow conduits through said passage in said buoy and through said lower rigid section;

connecting each of said additional flow conduits to a respective flow source on said preset base;

connecting additional flexible flowlines to the upper ends of respective said additional flow conduits at a point within said passage in said buoy; and connecting the other end of all of said flexible flowlines to a single means which is adapted to be connected to a floating facility on the surface.

* * * * *